US006993949B2

(12) United States Patent
Dole

(10) Patent No.: US 6,993,949 B2
(45) Date of Patent: Feb. 7, 2006

(54) POWER OR MANUALLY OPERATED PIPE GROOVING TOOL

(75) Inventor: Douglas R. Dole, Whitehouse Station, NJ (US)

(73) Assignee: Victaulic Company, Easton, PA (US)

( * ) Notice: Subject to any disclaimer, the term of this patent is extended or adjusted under 35 U.S.C. 154(b) by 135 days.

(21) Appl. No.: 10/777,938

(22) Filed: Feb. 12, 2004

(65) Prior Publication Data

US 2005/0178179 A1 Aug. 18, 2005

(51) Int. Cl.
*B21D 15/04* (2006.01)

(52) U.S. Cl. ..... 72/105; 72/444; 74/625

(58) Field of Classification Search ..... 72/2, 72/101, 102, 105, 106, 120, 121, 123, 441, 72/442, 444, 449, 453.16; 74/377, 545, 625
See application file for complete search history.

(56) References Cited

U.S. PATENT DOCUMENTS

| | | | | | |
|---|---|---|---|---|---|
| 1,295,614 | A | | 2/1919 | Scrimgeour | |
| 1,610,193 | A | | 12/1926 | Battle | |
| 2,183,921 | A | * | 12/1939 | Reuter et al. | 72/75 |
| 2,236,443 | A | | 3/1941 | Oboler | 33/178 |
| 2,572,999 | A | | 10/1951 | Elliott | 33/178 |
| 2,659,982 | A | | 11/1953 | Jakobi | 33/178 |
| 3,015,502 | A | | 1/1962 | Frost et al. | 285/112 |
| 3,107,048 | A | * | 10/1963 | Wentling | 415/124 |
| 3,473,359 | A | | 10/1969 | Joslin | 72/121 |
| 3,541,826 | A | | 11/1970 | Halliburton | 72/105 |
| 3,563,077 | A | | 2/1971 | Backe et al. | 72/108 |
| 3,673,832 | A | | 7/1972 | Bedker et al. | 72/35 |
| 3,903,722 | A | | 9/1975 | Thau, Jr. et al. | 72/105 |
| 3,995,466 | A | | 12/1976 | Kunsman | 72/106 |
| 4,041,747 | A | | 8/1977 | Elkin | 72/105 |
| 4,091,648 | A | | 5/1978 | McCaslin | 72/121 |
| 4,143,535 | A | | 3/1979 | Bouman | 72/119 |
| 4,160,329 | A | | 7/1979 | Scrimshaw | 33/178 D |
| 4,166,370 | A | | 9/1979 | Goodman | 72/105 |
| 4,336,703 | A | | 6/1982 | Thomas | 72/104 |
| 4,430,024 | A | | 2/1984 | Guild et al. | 405/232 |
| 4,454,739 | A | | 6/1984 | Ciccorelli | 72/73 |
| 4,736,607 | A | | 4/1988 | Wochnik | 72/177 |
| 4,781,233 | A | | 11/1988 | Williams | 157/16 |
| 5,079,940 | A | | 1/1992 | Pulver et al. | 72/105 |
| 5,101,684 | A | * | 4/1992 | Mosslacher | 74/625 |
| 5,104,031 | A | | 4/1992 | Wolfe | 228/154 |

(Continued)

OTHER PUBLICATIONS

Phoenix Fire Systems, Inc. "ULTRA-LOK" Products for Fire Sprinkler Piping System Brochure (5 pages) undated.
Victaulic® Tool Company VE-226 Operating Instructions for Roll Groovers (16 page manual) undated.
Victaulic® Tool Company Operating and Maintenance Instructions Manual for VE270FSD Pipe Roll Groove Tool, (34 page manual) dated Sep. 1998.

(Continued)

*Primary Examiner*—Ed Tolan
(74) *Attorney, Agent, or Firm*—Synnestvedt & Lechner LLP

(57) ABSTRACT

A pipe grooving tool is disclosed having a housing on which a back-up roller and a grooving roller are rotatably mounted. The grooving roller is pivotably movable toward the back-up roller and has a raised tool surface engageable with the outer surface of the pipe. The pipe is positioned with its sidewall between the rollers, and the back-up roller is rotated while the grooving roller is forcibly moved toward the back-up roller. A circumferential groove is formed around the pipe as the rollers traverse its circumference. A power drive shaft connected directly to the back-up roller is provided, the power drive shaft engaging a power drive unit on which the tool is mounted operated under power. A manual drive shaft is connected to the back-up roller through a torque multiplying gear and pinion transmission for manual operation of the tool.

22 Claims, 10 Drawing Sheets

U.S. PATENT DOCUMENTS

| | | | | | |
|---|---|---|---|---|---|
| 5,150,595 | A | | 9/1992 | Ihly | 72/124 |
| 5,291,769 | A | | 3/1994 | Miyano | 72/121 |
| 5,450,738 | A | | 9/1995 | Chatterley et al. | 72/106 |
| 5,477,720 | A | | 12/1995 | Lentz et al. | 72/124 |
| 5,528,919 | A | | 6/1996 | McGrady et al. | 72/121 |
| 5,535,938 | A | | 7/1996 | Leduc | 228/212 |
| 5,727,411 | A | | 3/1998 | Sakakibara et al. | 72/110 |
| 5,778,715 | A | | 7/1998 | Lippka et al. | 72/106 |
| 5,911,437 | A | * | 6/1999 | Lawrence | 280/766.1 |
| 5,950,472 | A | | 9/1999 | Grotnes et al. | 72/105 |
| 6,056,219 | A | * | 5/2000 | Barkley | 242/225 |
| 6,164,106 | A | | 12/2000 | Nghiem et al. | 72/20.1 |
| 6,196,039 | B1 | | 3/2001 | Williams et al. | 72/105 |
| 6,244,088 | B1 | | 6/2001 | Compton | 72/105 |
| 6,272,895 | B1 | | 8/2001 | Hamm | 72/105 |

OTHER PUBLICATIONS

Victaulic® Tool Company Operating and Maintenance Instructions Manual for VE416FS & VE416FSD Pipe Roll Grooving Tools (35 page manual) dated May 1997.

Ridgid Pipe Fabrication Portable Roll Groover/Model 915, (1 page) undated.

Ridgid Roll-Grooving undated (2 pages downloaded from website on Jun. 17, 2003.

Reed Manufacturing Company Portable Roll Groovers (2003) (2 pages downloaded from website on Jun. 17, 2003.

* cited by examiner

POWER OR MANUALLY OPERATED PIPE GROOVING TOOL

FIELD OF THE INVENTION

This invention relates to tools that create circumferential grooves in pipes to allow the pipes to be connected together end to end using mechanical couplings.

BACKGROUND OF THE INVENTION

Mechanical couplings 10, as shown in FIG. 1, are used to couple pipes 12 and 14 to one another and effect a fluid tight joint. Couplings 10 may comprise a pair of segments 16 and 18 that are joined to one another end to end by fasteners 20 to circumferentially surround the ends of pipes 12 and 14. To effect a substantially rigid joint, i.e., a joint which resists relative rotation of the pipes 12 and 14 about their longitudinal axes, resists axial motion of the pipes relatively to one another due to internal pressure, and resist angular deflection of the pipes relatively to one another, it is advantageous to position circumferentially extending grooves 22 and 24 around each pipe. The grooves 22 and 24 are positioned in spaced relation to the ends of the pipes 12 and 14 and are sized to receive arcuately shaped keys 26 and 28 extending from each segment 16 and 18. Engagement of the keys 26 and 28 with grooves 22 and 24 substantially rigidizes the joint formed by coupling 10. Fluid tightness of the joint is ensured by a sealing member 30 positioned between the pipes 12 and 14 and the coupling segments 16 and 18.

Assembly of piping networks using mechanical pipe couplings 10 may entail that pipe stock be cut to a desired length, the cut pipe segments be reamed to remove burrs and sharp edges, and grooves such as 22 and 24 be formed in both ends of each cut pipe segment. The cut, reamed and grooved pipe segments may then be joined to one another using the couplings 10.

Forming circumferential grooves in pipes made of malleable materials such as plastics, copper, steel and aluminum is advantageously accomplished by cold working the material beyond its yield stress, thereby causing a permanent deformation in the material. Existing techniques for forming circumferential grooves in metal and plastic pipes entail sandwiching the pipe sidewall between the circumferences of two adjacent rotatable rollers. One roller, known as the back-up roller, is positioned on the inside of the pipe, and the other, known as the grooving roller, is positioned on the outside. The back-up roller has a concave die around its outer circumference and the grooving roller has a raised grooving surface around its outer circumference. With the pipe sidewall between them, the rollers are rotated in opposite directions and are forced toward one another so that they apply pressure to the sidewall. The die and the grooving surface traverse the pipe circumference and cooperate to cold work the sidewall and produce a circumferential groove of the desired size and shape. The rollers may move relatively to the pipe or the pipe may rotate about its longitudinal axis and move relatively to stationary rollers.

The method using a grooving roller and a back-up roller is effective at forming grooves in pipe walls while maintaining the roundness of the pipe because the pipe sidewall is mutually supported between the rollers and is never subjected to compressive point loads which would tend to collapse the pipe or force it out of round. Both rollers cooperate to work the material comprising the pipe, the grooving roller forming the groove and the back-up roller acting as a die to control the flow of material during cold working and precisely define the groove shape.

It is convenient, especially for larger diameter pipe stock and harder materials such as steel, to use electrically powered tools to perform the various operations. However, electrical power is not always available, especially at remote sites in the field. Therefore, it would be advantageous to have a pipe grooving tool that can be operated either using electrical power, when available, or manually, when electrical power is not available. Furthermore, it is less costly to have a single tool for both manual and power operation as opposed to having two separate tools, each dedicated to only one mode of operation.

SUMMARY OF THE INVENTION

The invention concerns a grooving tool for forming a groove in a sidewall of a pipe circumferentially around the pipe. The grooving tool is capable of engaging a power drive unit for power operation and can accept a hand crank for manual operation when no power is available. The grooving tool comprises a housing and a grooving roller mounted on the housing. The grooving roller is rotatable about a first axis. The grooving roller has a raised circumferential surface portion engageable with the sidewall for forming the groove. A back-up roller is mounted on the housing adjacent to the grooving roller. The back-up roller is rotatable about a second axis that may be oriented substantially parallel to the first axis or at a small angle thereto. One of either the grooving roller or the back-up roller is movable toward and away from the other of the rollers for positioning the pipe sidewall between the rollers and forcibly engaging the rollers with the sidewall on opposite sides. A first shaft is attached to either the grooving or back-up rollers and projects outwardly from the housing. The first shaft is engageable with the power drive unit, and rotation of the power drive unit causes the first shaft and the one roller to which it is attached to rotate. Preferably, the first shaft is attached to the back-up roller. When it is engaged with the pipe sidewall, rotation of the back-up roller causes the pipe to rotate, and the pipe causes the grooving roller to rotate. The grooving and back-up rollers traverse the circumference of the rotating pipe and form the groove as they are forcibly moved toward each other, cold-working the sidewall.

The grooving tool also has a second shaft rotatably mounted on the housing. The second shaft extends outwardly from the housing and is engageable with the hand crank. A transmission is mounted on the housing. The transmission extends between the first and the second shafts such that rotation of the second shaft causes rotation of the first shaft, thereby rotating the one roller to which the first shaft is attached (preferably the back-up roller as noted above). When manually operated, the power drive unit is not engaged with the first shaft. The second shaft is turned manually, thereby turning the first shaft through the transmission. This causes rotation of the one roller (preferably the back-up roller) to which the first shaft is attached. In operation, the rollers are first brought towards one another into engagement with the pipe sidewall and then the crank is turned. The rollers traverse the circumference of the pipe and begin to form the groove. This is accomplished either by the pipe rotating relatively to the rollers or the rollers moving around the circumference of the pipe, which is stationary. Between each revolution, the rollers are forced further into engagement with the pipe sidewall, and the sidewall is cold-worked in a series of steps to form the desired groove.

Preferably, the grooving roller is rotatably mounted on a secondary housing that is pivotably mounted on the housing. The secondary housing allows the grooving roller to be pivotably movable toward and away from the back-up roller upon pivoting motion of the secondary housing. A means for forcibly pivoting the secondary housing relatively to the housing is provided. The pivoting means preferably comprises a jackscrew assembly having a first end engaged with the housing and a second end engaged with the secondary housing. Rotation of the jackscrew assembly pivotally moves the secondary housing relatively to the housing to forcibly engage the rollers with the pipe sidewall.

DETAILED DESCRIPTION OF THE EMBODIMENTS

Figure 1:
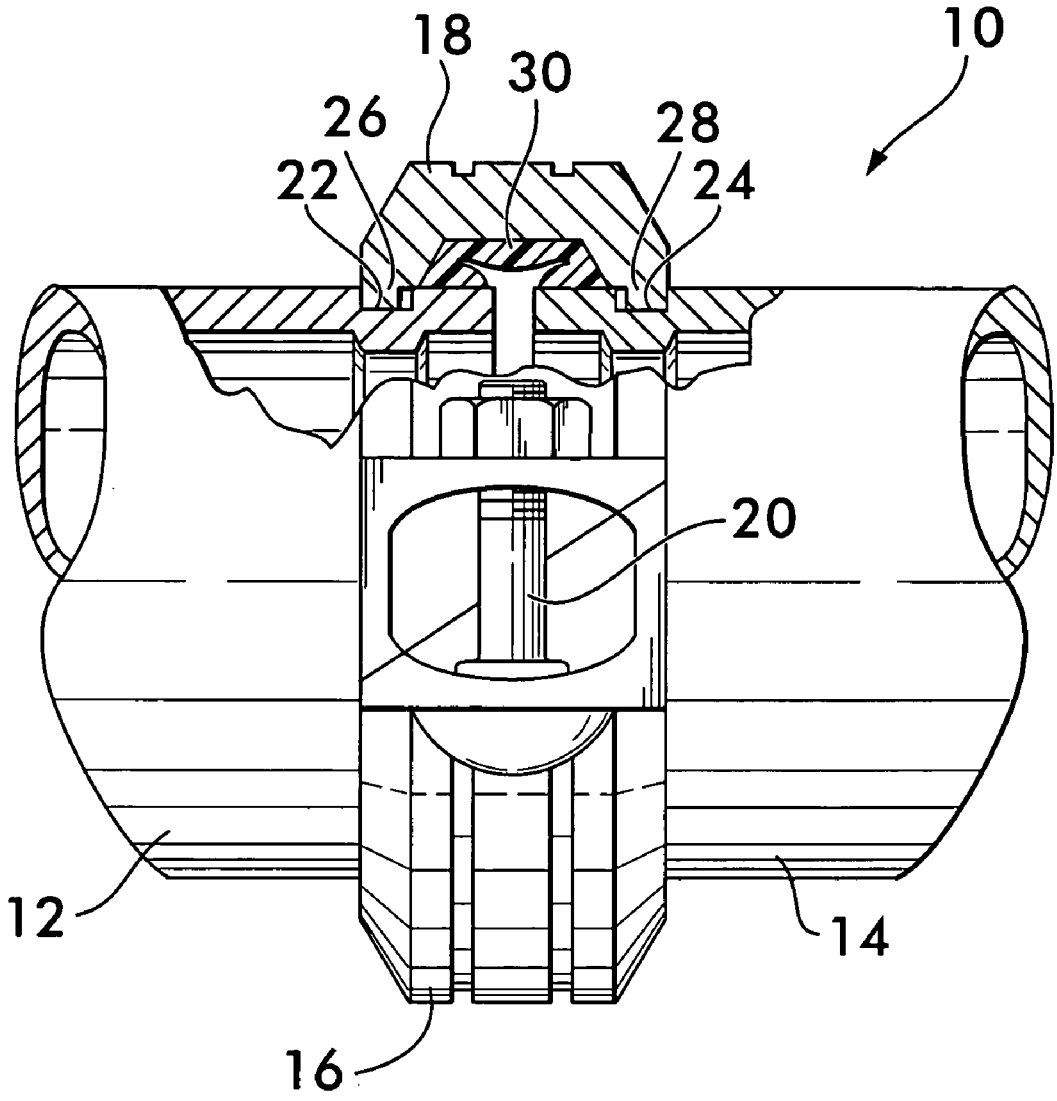
FIG.1 PRIOR ART
FIG. 1 is a partial sectional view of a pipe joint formed using a mechanical fitting.
Figure 2:
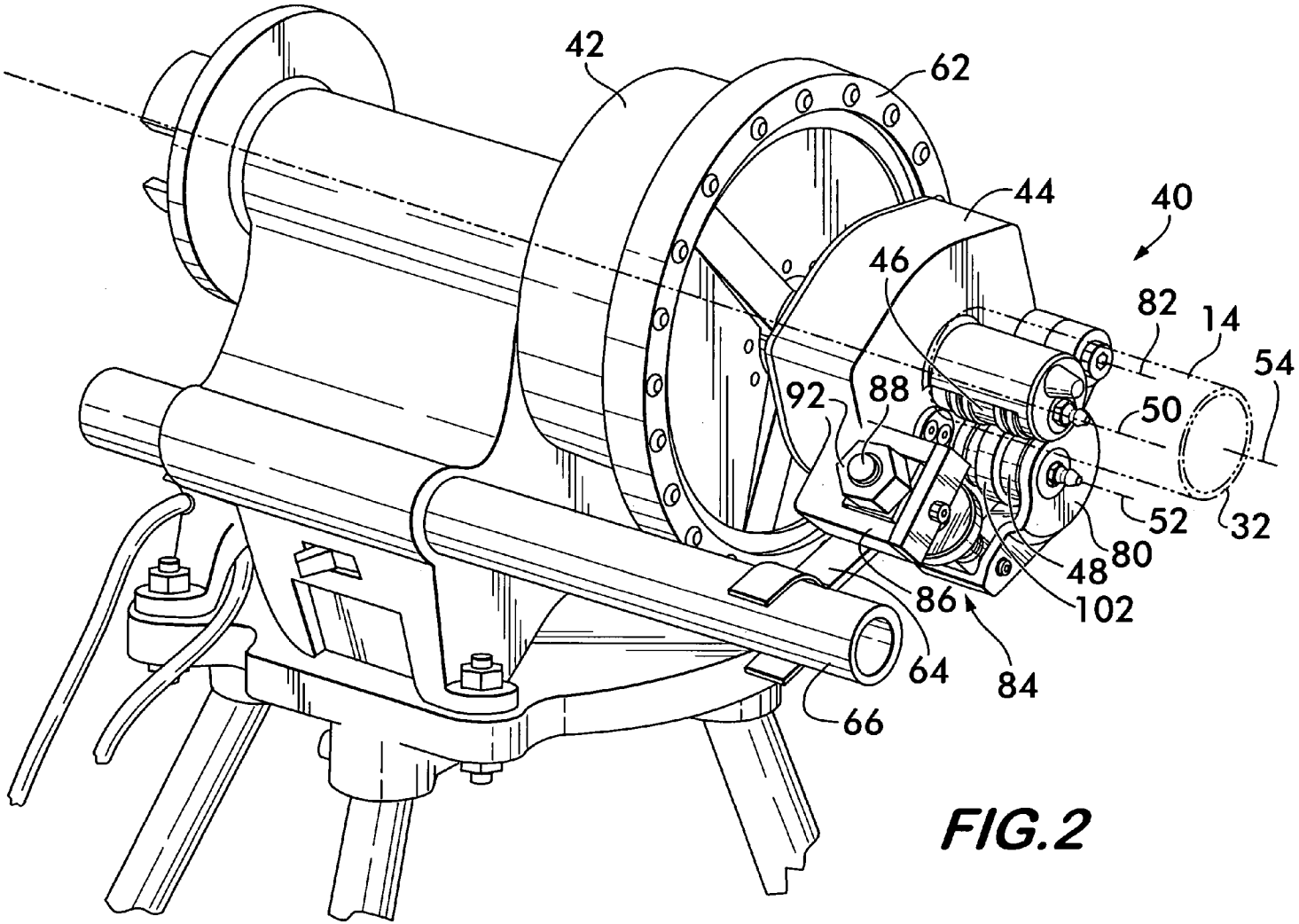
FIG. 2 is a perspective view of a grooving tool according to the invention mounted on a power drive unit.

FIG. 2 shows a grooving tool 40 according to the invention removably mounted on a power drive unit 42 for power operation. Grooving tool 40 comprises a housing 44 on which are mounted a back-up roller 46 and a grooving roller 48, positioned adjacent to the back-up roller. The back-up roller 46 is rotatable about an axis 50, and the grooving roller 48 is rotatable about an axis 52. Both axes of rotation 50 and 52 are preferably substantially parallel to one another and to the longitudinal axis 54 of pipe 14, shown in phantom line with its sidewall 32 positioned between the rollers 46 and 48 for formation of a circumferential groove. It is also feasible to skew the axes relatively to one another and the pipe axis 54 by a few degrees to help ensure that the grooving tool tracks along the same path around the pipe.

Figure 3:
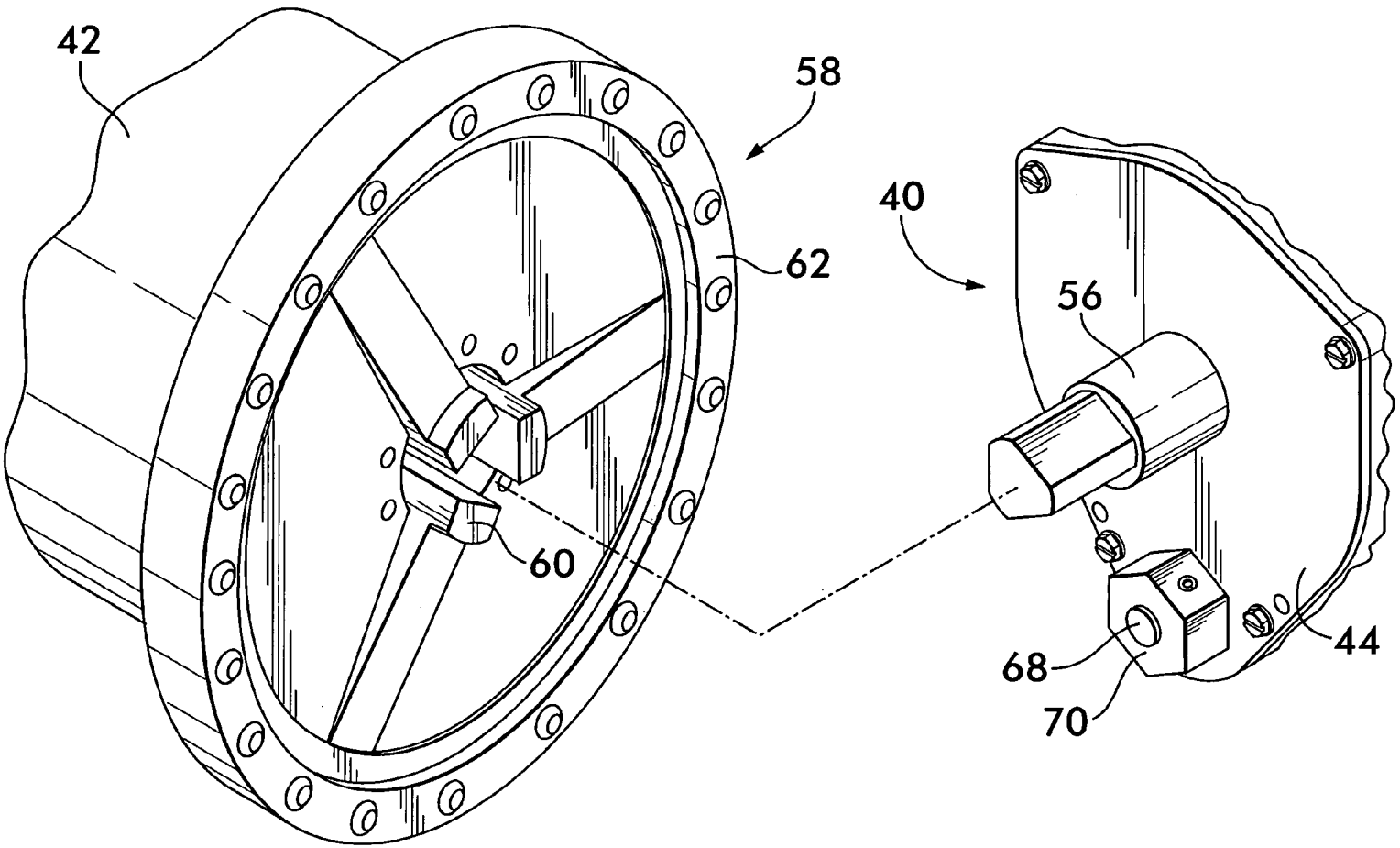
FIG. 3 is a partial perspective exploded view of a portion of the tool shown in FIG. 2.
Figure 6:
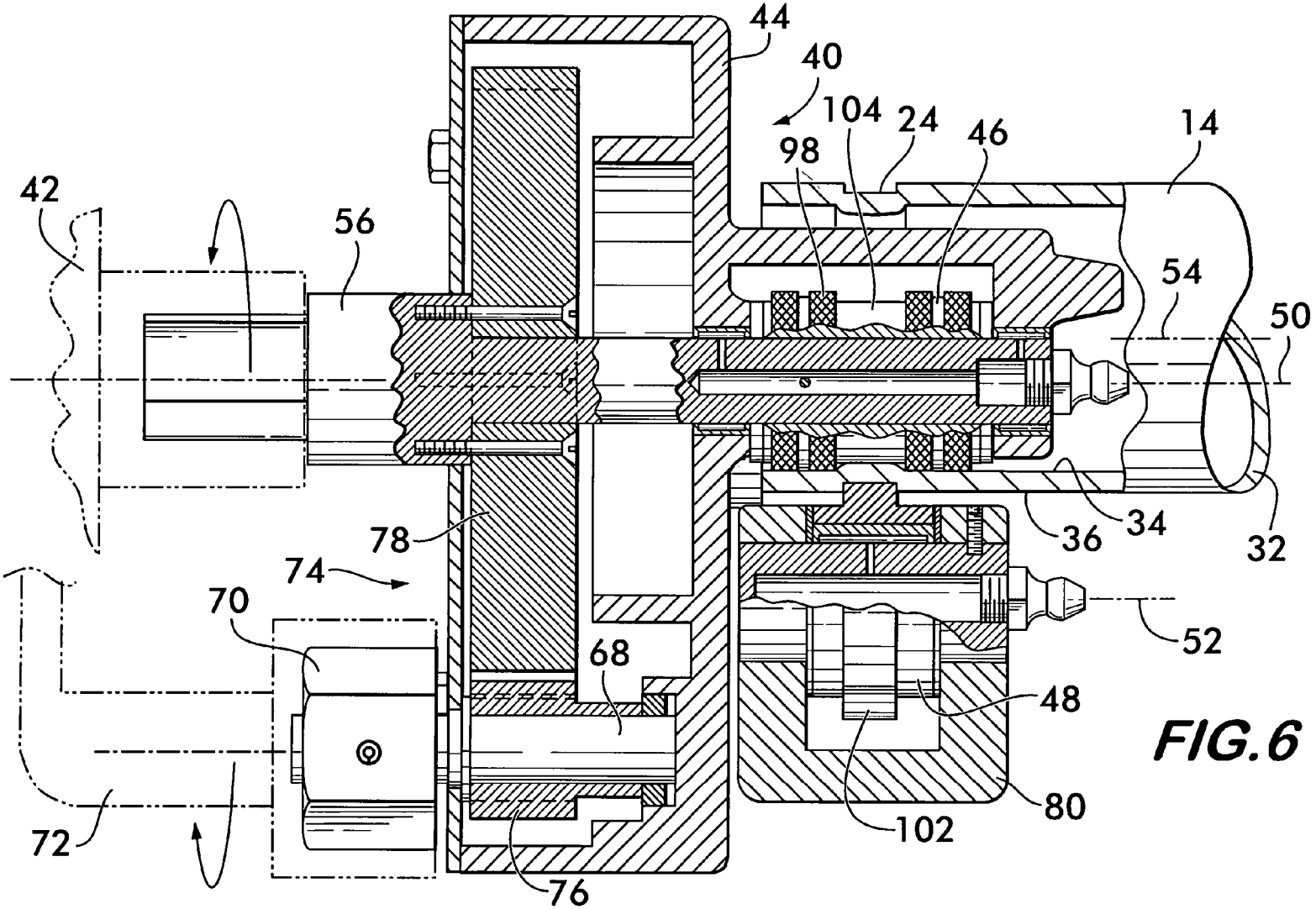
FIG. 6 is a longitudinal sectional view taken at line 6—6 in FIG. 5.

Preferably, as shown in FIG. 6, back-up roller 46 is attached to a power drive shaft 56 rotatably mounted on housing 44. Power drive shaft 56 directly turns the back-up roller 46 about axis 50. As best shown in FIG. 3, the power drive shaft 56 extends outwardly from housing 44 and is engageable with a chuck 58 of the power drive unit. Chuck 58 has jaws 60 that are movable into and out of engagement with power drive shaft 56 by rotating a chuck ring 62. Grooving tool 40 is mounted on the power drive unit 42 for power operation by rotating the chuck ring 62 to open jaws 60 (FIG. 3), engaging the power drive shaft 56 within the jaws, and then turning the chuck ring to lock the jaws onto the power drive shaft (FIG. 2). An electric motor (not shown) in the power drive unit 42 rotates the power drive shaft 56, thereby rotating the back-up roller 46. An anti-torque arm 64 is mounted on housing 44 and engages a stationary mounting rail 66 extending from the power drive unit 42 to prevent the housing 44 from turning when torque is applied to the power drive shaft 56.

As shown in FIG. 6, a manual drive shaft 68 is also rotatably mounted on housing 44. Manual drive shaft 68 extends outwardly from housing 44 and has a hex-head nut 70 attached to it. Hex-head nut 70 is engaged by a hand crank 72, partially shown in phantom line (see also FIG. 8) allowing the manual drive shaft 68 to be turned by hand during manual operation of the grooving tool 40, described below.

Figure 5:
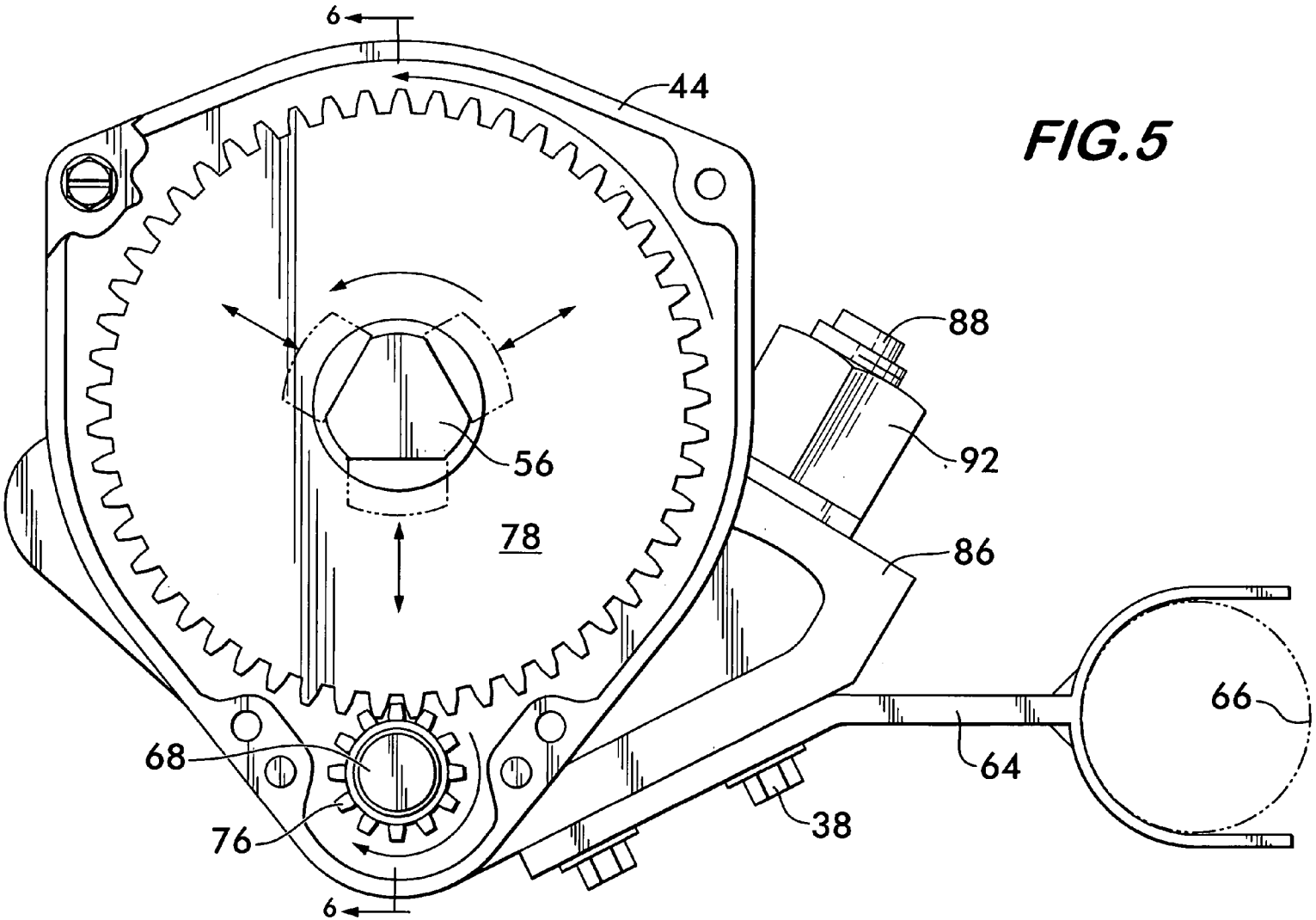
FIG. 5 is a partially cut-away rear end view of the tool shown in FIG. 2.

With reference again to FIG. 6, manual drive shaft 68 is connected to the power drive shaft 56 by a transmission 74 mounted on housing 44. Transmission 74 transmits torque applied to manual drive shaft 68 by hand crank 72 to the power drive shaft 56 to turn the back-up roller 46. As best shown in FIG. 5, transmission 74 preferably comprises a pinion 76 mounted on manual drive shaft 68 that engages a gear 78 mounted on the power drive shaft 56. Preferably, the ratio of the pitch diameter of the gear 78 to the pinion 76 is between about 3 to 1 and about 8 to 1, i.e., the pitch diameter of the gear is between about 3 to 8 times greater than the pitch diameter of the pinion. This will provide a mechanical advantage of between about 3 to 1 and 8 to 1 when turning the back-up roller 46 during manual operation.

Figure 7:
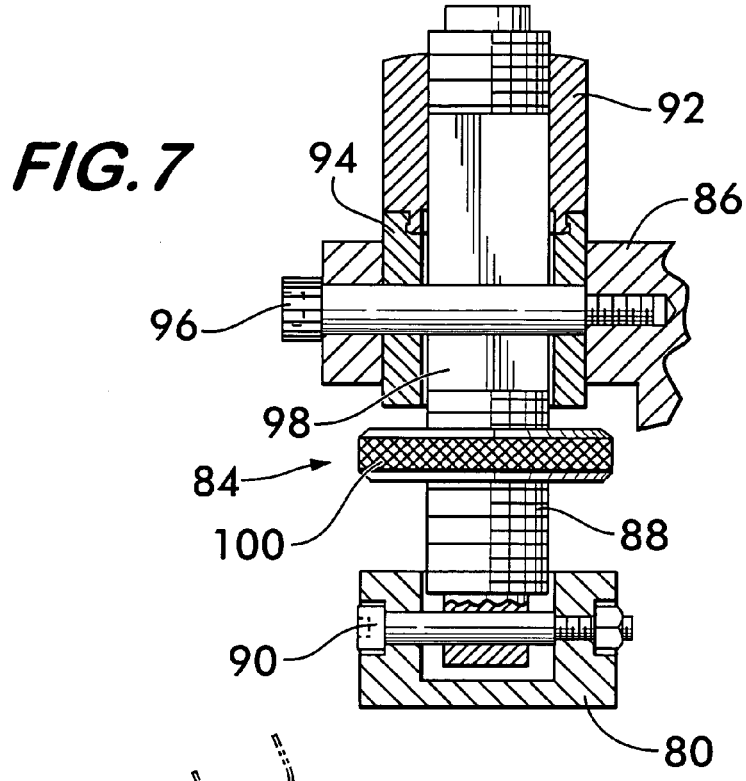
FIG. 7 is a longitudinal sectional view taken at line 7—7 of FIG. 4.

As best shown in FIG. 2, grooving roller 48 is rotatably mounted in a secondary housing 80 mounted on housing 44. Secondary housing 80 pivots about axis 82 relatively to housing 44, allowing the grooving roller 48 to be moved toward and away from the back-up roller 46. Means for forcibly pivoting the secondary housing 80 relatively to housing 44 are provided, preferably in the form of a jackscrew assembly 84, best shown in FIGS. 4 and 7. Jackscrew assembly 84 is positioned in spaced relation away from pivot axis 82 and extends through a fitting 86 attached to housing 44. The jackscrew assembly 84 comprises a jackscrew 88, one end of which is attached to secondary housing 80 by a pivot bolt 90. The opposite end of jackscrew 88 is engaged by a threaded nut 92 that engages a sleeve 94 pivotably mounted to the fitting 86 by a bolt 96. The jackscrew has a slot 98 enabling it to traverse the bolt 96. Rotation of nut 92 will move the jackscrew 88 relatively to the fitting 86, thereby pivoting the secondary housing 80 about pivot axis 82 for movement of the grooving roller 48 toward and away from the back-up roller 46. A knurled stop ring 100 is positioned on the jackscrew 88 beneath the fitting 86. The position of the stop ring 100 may be adjusted along the jackscrew 88 to control the limit of pivoting motion of the secondary housing 80 toward the back-up roller 46. Stop ring 100 controls the depth of the groove in the pipe.

Other means for pivoting the secondary housing may also be used, such as hydraulic, pneumatic, as well as electrical actuators. Furthermore, although it is preferred to turn the back-up roller and move the grooving roller toward it, it is also feasible to turn the grooving roller and move the back-up roller, or turn both rollers and move both rollers relatively to one another and the housing.

Figure 4:
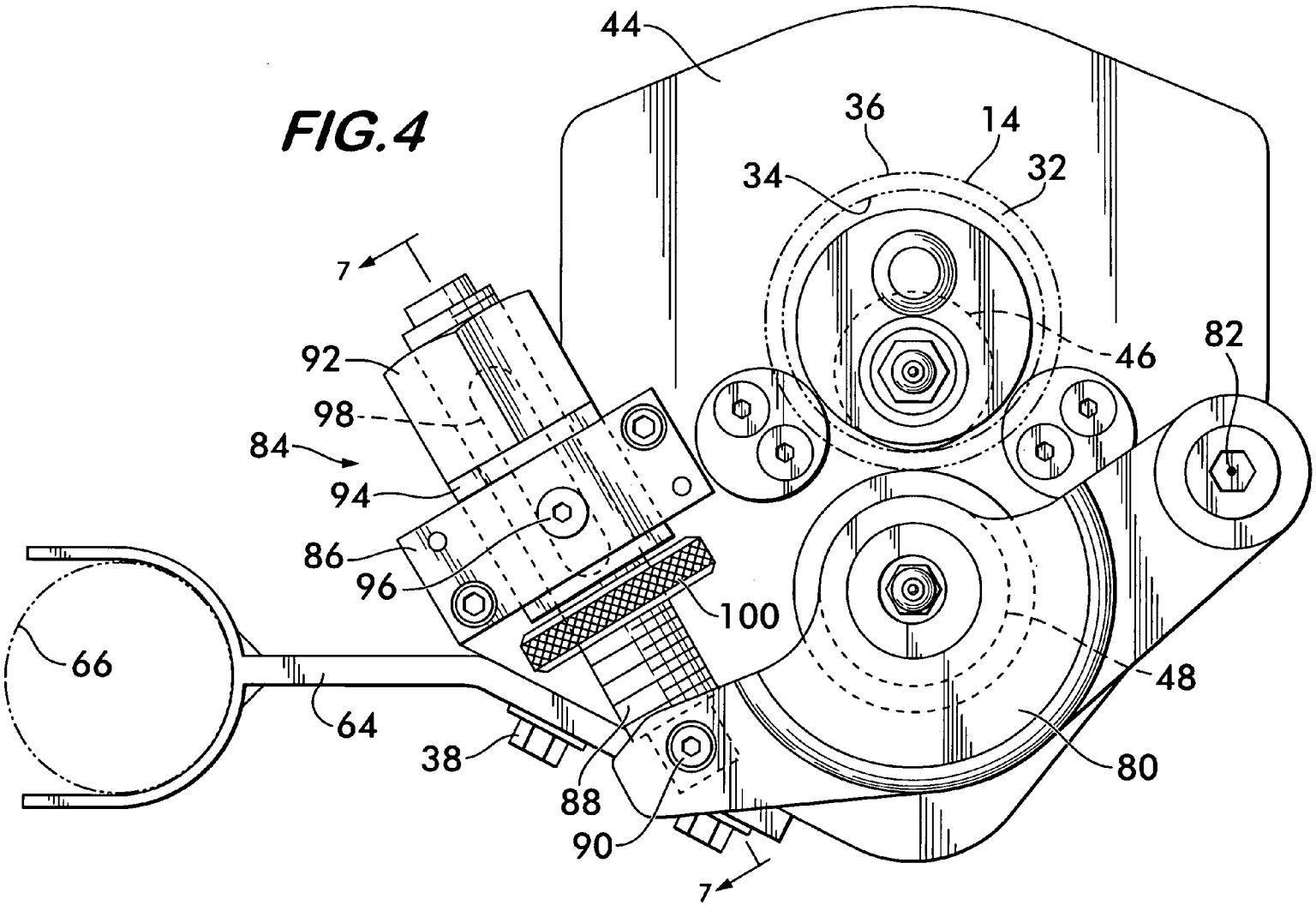
FIG. 4 is a front end view of the tool shown in FIG. 2.

Power operation of the grooving tool 40 is illustrated with reference to FIGS. 2, 4 and 6. With reference to FIG. 2, the grooving roller 48 is moved away from back-up roller 46 by pivoting secondary housing 80 about pivot axis 82 using jackscrew assembly 84. Pipe 14 is positioned so that its sidewall 32 is located between the rollers, and the grooving roller 48 is pivoted toward the back-up roller 46 until both rollers engage opposite surfaces of the sidewall 32 as shown in FIG. 4. The power drive unit 42, shown in FIG. 2, is switched on and turns power drive shaft 56 as shown in FIG. 6. Power drive shaft 56 turns back-up roller 46 about its axis 50, the roller being engaged with the inner surface 34 of sidewall 32. Friction between the back-up roller 46 and inner surface 34 causes the pipe 14 to rotate about its longitudinal axis 54 in response to the rotation of the back-up roller 46. Preferably, the back-up roller has knurled circumferential surfaces 98 which provide increased traction between the back-up roller and the pipe to ensure that the pipe 14 rotates.

When pipe 14 rotates, friction between it and the grooving roller 48 causes the grooving roller to rotate about its rotation axis 52, the grooving roller thereby traversing the circumference of pipe 14. As the pipe 14 rotates, the nut 92 of the jackscrew assembly 84 (see FIGS. 2 and 4) is turned to pivot the grooving roller 48 toward the back-up roller 46, both rollers being forcibly engaged with the sidewall 32. Grooving roller 48 has a raised circumferential surface 102, best shown in FIG. 6, that engages the outer surface 36 of sidewall 32 and forms the groove 24 by cold-working the sidewall. The nut 92 is turned incrementally as pipe 14 rotates to apply greater pressure between the rollers and the sidewall surfaces 34 and 36 with each revolution of the pipe so as to gradually form the groove 24 to the desired depth and shape. The depth is determined substantially by the height of raised surface 102 and the degree to which it is pressed into the outer surface 36 of sidewall 32. The shape of the groove is determined by the shape of the raised surface 102 and by the shape of the opposing surface 104 of the back-up roller 46, which acts as a die to control the flow of material comprising the sidewall.

Figure 8:
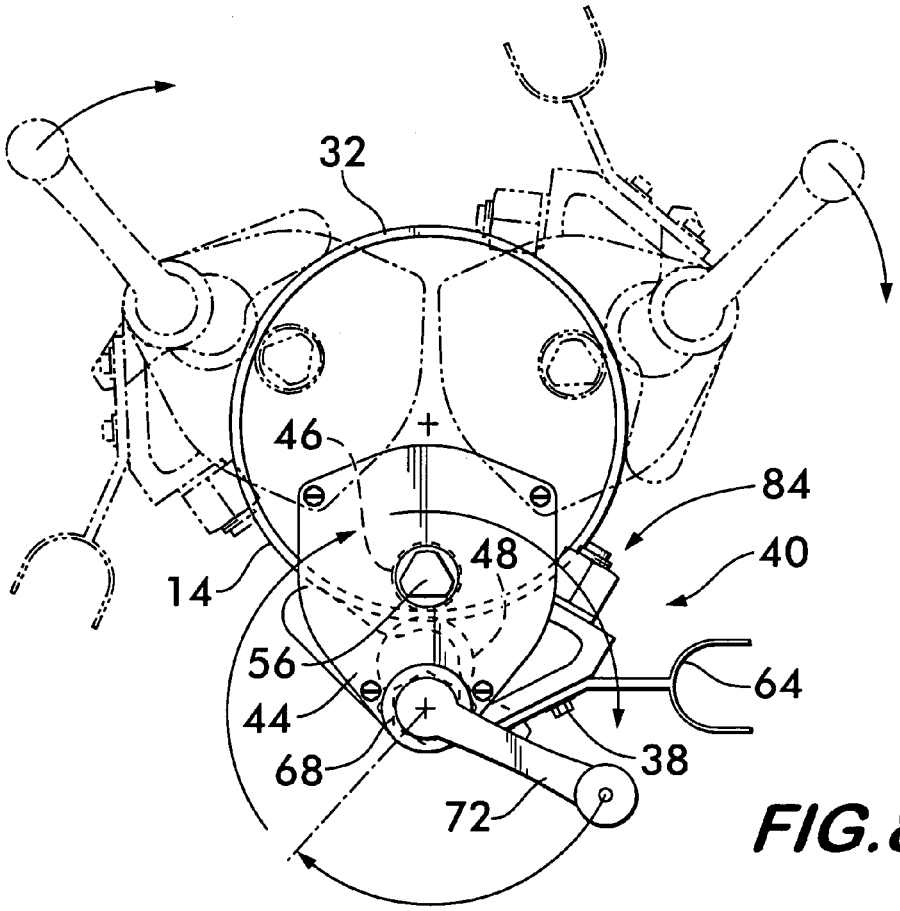
FIG. 8 is a rear end view of the tool shown in FIG. 2 being manually operated.

Manual operation of pipe grooving tool 40 is illustrated in FIG. 8. Manual operation is convenient when there is no electrical power available or when the diameter of the pipe is so large as to not be practically accommodated on the power drive unit. Manual operation is advantageous for grooving pipes in existing piping networks because it permits grooves to be formed without removing the pipe from the network.

As shown in FIG. 8, grooving tool 40 is removed from the power drive unit and the hand crank 72 is fitted to the manual drive shaft 68. The grooving roller 48 is pivoted away from the back-up roller 46 using jackscrew assembly 84 and the tool 40 is positioned on the pipe 14 with the pipe sidewall 32 positioned between the rollers 46 and 48. The grooving roller 48 is pivoted toward the back-up roller 46 until both rollers engage the pipe sidewall 32, as shown in the solid line depiction of tool 40 in FIG. 8. With the rollers forcibly engaged with the sidewall 32, the hand crank 72 is turned, in this example, in a clockwise direction. The hand crank 72 applies torque to the manual drive shaft 68 which, being coupled to the power drive shaft 56 by a gear and pinion transmission (see FIG. 6), turns the power drive shaft. The back-up roller 46, attached to the power drive shaft 56 is forced to turn. Friction between the back-up roller 46 and the pipe sidewall 32 propels the grooving tool 40 around the pipe and the grooving roller 48 traverses the outer circumference of the pipe 14 in a clockwise direction as indicated by multiple views of the grooving tool 40 shown in phantom line. The jackscrew assembly 84 is incrementally tightened with each revolution of the grooving tool 40 around the pipe 14, forcing the raised surface 102 of the grooving roller 48 as described above into the sidewall 32 to form a groove of the desired shape and depth. The anti-torque arm 64 is shown attached to the housing 44, but may be removed for manual operation if desired by removing fasteners 38 holding the arm 64 to the housing.

Figure 9:
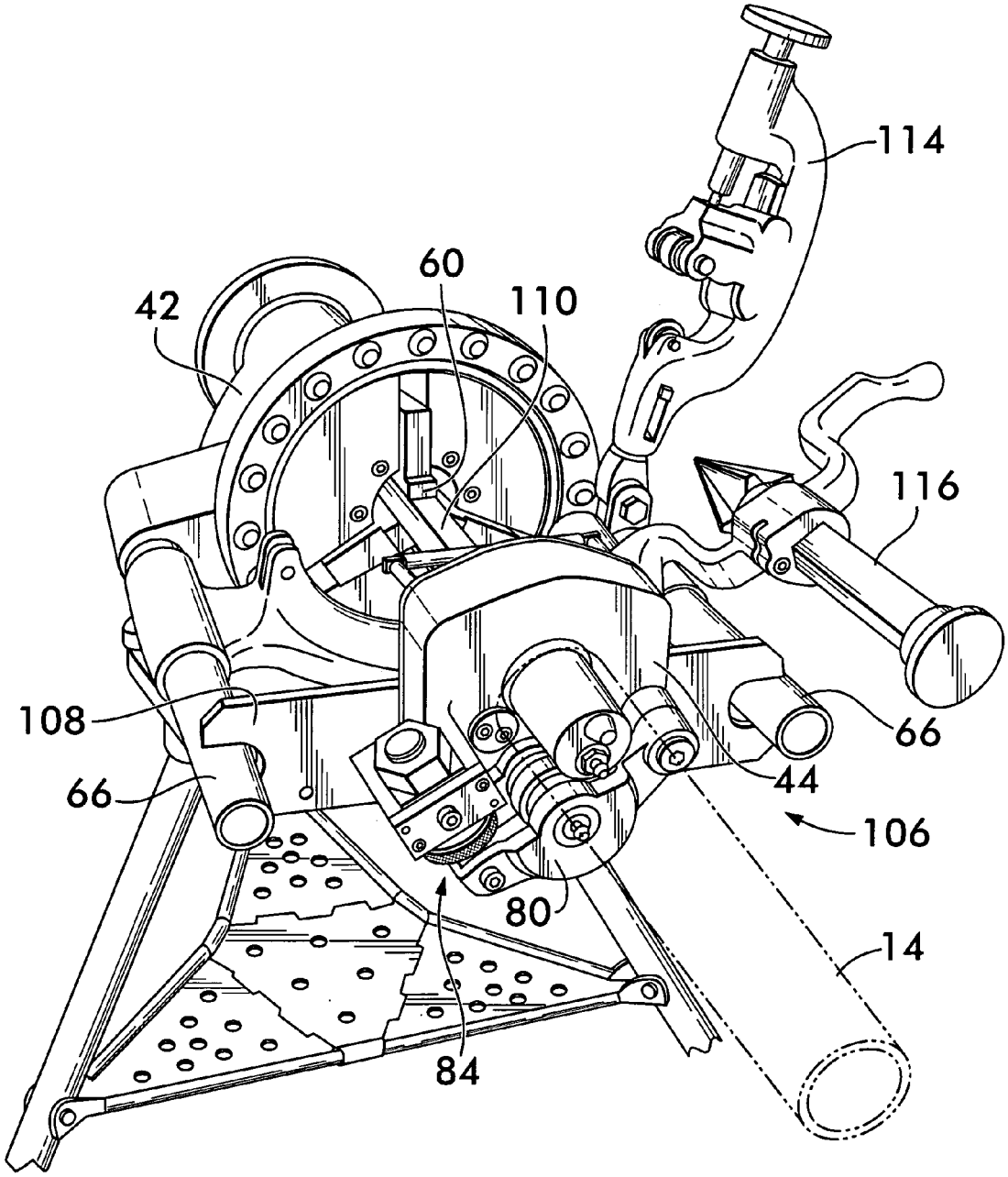
FIG. 9 is a perspective view of another embodiment of a tool according to the invention.

FIG. 9 shows another embodiment of the grooving tool 106 according to the invention. Grooving tool 106 includes an anti-torque arm 108 that is removably attached to housing 44 and extends across the entire width of the power drive unit 42, the arm 108 engaging mounting rails 66 on either side of the unit 42.

Figure 10:
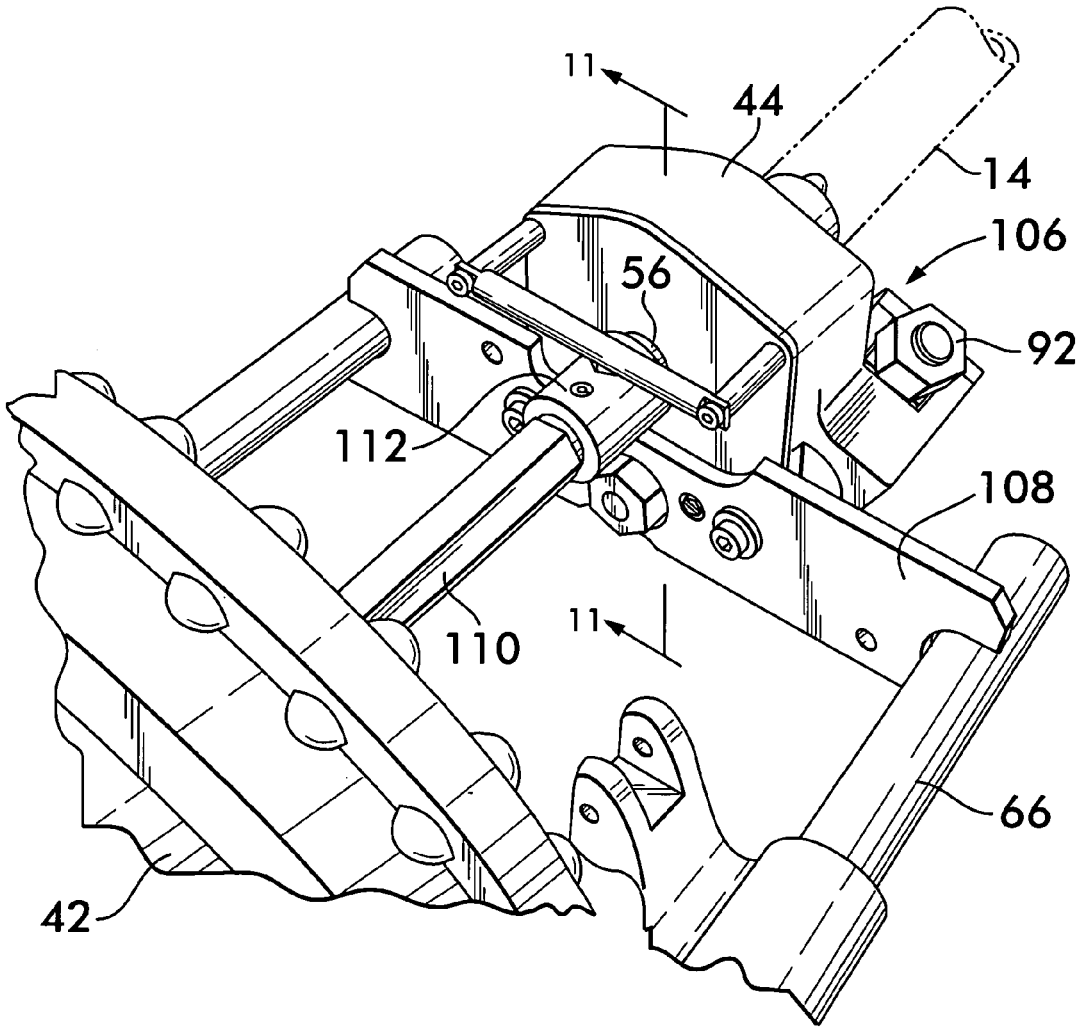
FIG. 10 is a partial perspective rear view of the tool shown in FIG. 9.
Figure 11:
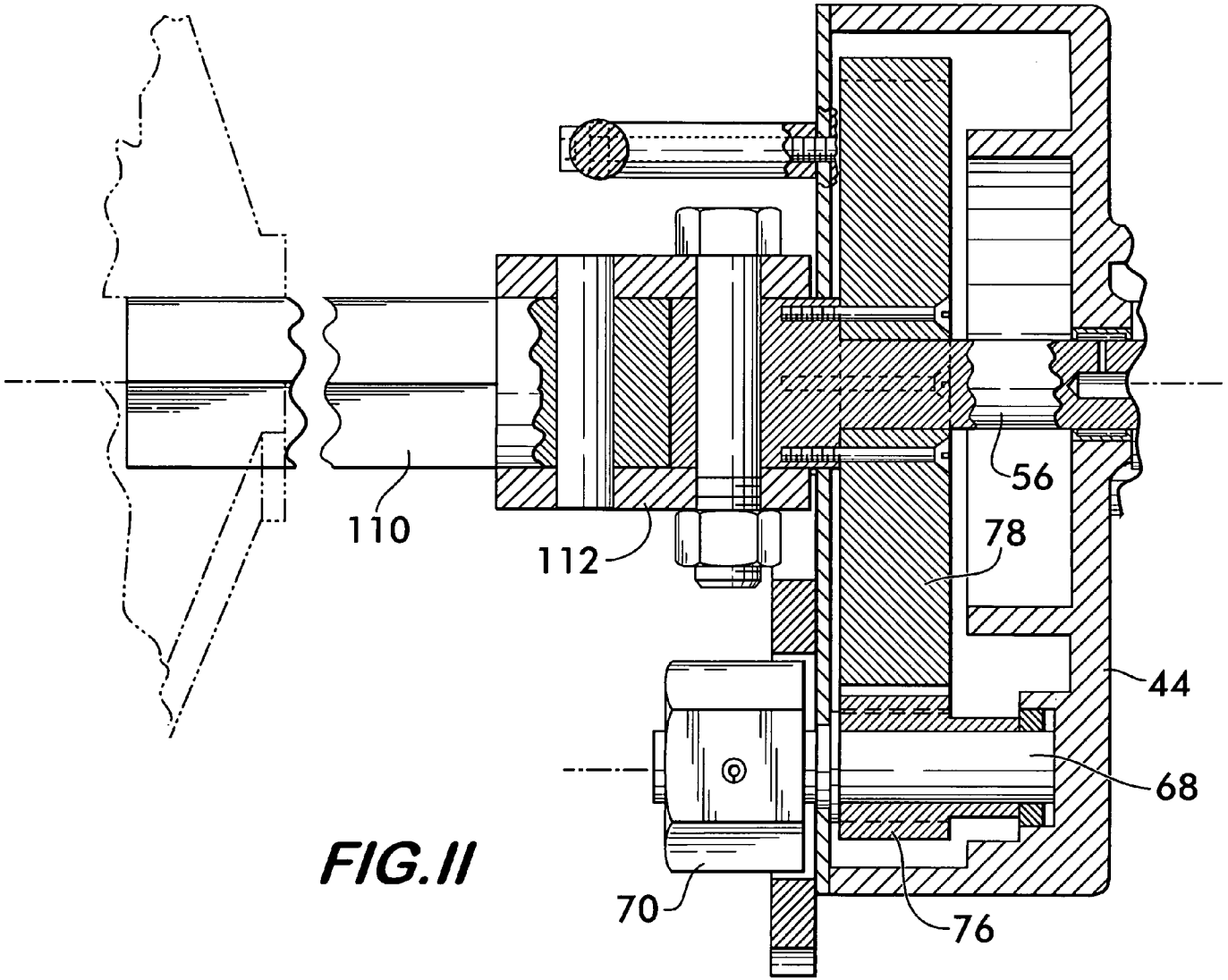
FIG. 11 is a longitudinal sectional view taken at line 11—11 of FIG. 10.

Grooving tool 106 also includes an elongated extension shaft 110, one end of which engages the jaws 60 of the power drive unit 42. As shown in FIGS. 10 and 11, the other end of extension shaft 110 engages the power drive shaft 56 through a coupling 112.

Use of the extension shaft 110 for power operation allows the grooving tool 106 to be positioned in spaced relation away from the power drive unit 42, thereby allowing various pipe preparation tools, such as a pipe cutter 114 and a reamer 116, to remain on the mounting rails 66 when the grooving tool 106 is used to groove pipe 14. Without the extension shaft 110, the pipe preparation tools must be removed from rails 66 so as not to interfere with the grooving tool. Conversion of the unit by removing and remounting the pipe preparation tools wastes valuable time which could otherwise be more profitably spent on pipe preparation.

Grooving tools 40 and 106 according to the invention having separate respective drive shafts for manual and power operation provide distinct advantages over other grooving tools having only one drive shaft for both operational modes. Single drive shaft tools tend to be appropriate for only one mode of operation; either manual or power operation, but not both, as explained below.

Single drive shaft tools wherein the drive shaft is connected directly to the driven roller, whether it is the back-up or the grooving roller, are appropriate for power operation but, because no mechanical advantage is provided, are disadvantageous for manual operation. The lack of a mechanical advantage which would otherwise reduce the applied torque necessary to turn the drive shaft makes it physically difficult and tiresome to manually crank the shaft, and it, therefore, takes more time and effort to form the groove.

In contrast, single shaft tools wherein the drive shaft drives the driven roller through a torque multiplying gear train are appropriate for manual operation because a mechanical advantage is provided which allows the drive shaft to be more easily turned manually. However, a concomitant reduction in rotation speed of the driven roller relative to the drive shaft is occasioned to obtain the mechanical advantage. The driven roller moves slower during power operation as a result, providing a disadvantage.

Dual shaft grooving tools according to the invention have a manual drive shaft and a power drive shaft. The manual drive shaft is connected to the driven roller through a transmission that provides a mechanical advantage during manual operation where the applied torque is multiplied. The speed of rotation, although lower, is not of significance during manual operation; it is more important to be able to operate the tool with a lower applied torque, so the rotation speed is sacrificed. The power drive shaft, which is preferably connected directly to the driven roller, and which runs at the same speed as the chuck 58, does not suffer an unnecessary speed reduction and, therefore, provides an advantage during power operation.

What is claimed is:

1. A grooving tool for forming a groove in a sidewall of a pipe circumferentially around said pipe, said grooving tool being capable of engaging a power drive unit for power operation thereof and a hand crank for manual operation, said grooving tool comprising:

a housing;

a grooving roller mounted on said housing and rotatable about a first axis, said grooving roller having a raised circumferential surface portion engageable with said sidewall for forming said groove;

a back-up roller mounted on said housing adjacent to said grooving roller, said back-up roller being rotatable about a second axis, one of said grooving roller and said back-up roller being movable toward and away from the other of said rollers for positioning said sidewall between said rollers and forcibly engaging said rollers with said sidewall on opposite sides of said sidewall;

a first shaft attached to one of said grooving and back-up rollers, said first shaft being engageable with said power drive unit, rotation of said power drive unit causing said first shaft and said one roller to rotate;

a second shaft rotatably mounted on said housing, said second shaft being engageable with said hand crank; and a transmission mounted on said housing, said transmission extending between said first and said second shafts such that rotation of said second shaft causes rotation of said first shaft thereby rotating said one roller, rotation of said one roller by one of said power drive unit and said hand crank causing relative rotation between said pipe and said rollers for forming said groove.

2. A grooving tool according to claim 1, wherein said second axis is substantially parallel to said first axis.

3. A grooving tool according to claim 1, wherein said first shaft is attached to said back-up roller, said first shaft being substantially coaxially aligned with and rotatable about said second axis.

4. A grooving tool according to claim 3, wherein said back-up roller has a textured circumferential surface for engaging an inner surface of said sidewall.

5. A grooving tool according to claim 1, wherein said transmission comprises:

a gear attached to said first shaft and positioned coaxial therewith; and a pinion attached to said second shaft and positioned coaxial therewith, said pinion engaging said gear, said pinion transmitting rotational motion of said second shaft to said first shaft.

6. A grooving tool according to claim 5, wherein said gear has a pitch diameter between about 3 and about 8 times greater than said pinion.

7. A grooving tool according to claim 3, further comprising:

a secondary housing pivotably mounted on said housing, said grooving roller being rotatably mounted on said secondary housing, said grooving roller being pivotably movable toward and away from said back-up roller upon pivoting motion of said secondary housing; and means for forcibly pivoting said secondary housing relatively to said housing, said sidewall being positionable between said grooving and said back-up rollers, said rollers being forcibly engageable with said sidewall upon pivoting motion of said grooving roller toward said back-up roller by said pivoting means.

8. A grooving tool according to claim 7, wherein said pivoting means comprises a jackscrew assembly having a first end engaged with said housing and a second end engaged with said secondary housing, rotation of said jackscrew assembly pivotally moving said secondary housing relatively to said housing.

9. A grooving tool according to claim 1, further comprising an anti-torque arm mounted on said housing, said anti-torque arm being engageable with said power drive unit and preventing said housing from turning when said first shaft is rotated.

10. A grooving tool according to claim 9, wherein said anti-torque arm is removably mounted on said housing.

11. A grooving tool according to claim 1, further comprising an elongated extension shaft having a first end engageable with said power drive unit and a second end engageable with said first shaft, said extension shaft permitting engagement of said power drive unit to said first shaft with said grooving tool in spaced apart relation to said power drive unit.

12. A grooving tool for forming a groove in a sidewall of a pipe circumferentially around said pipe, said grooving tool being capable of both power and manual operation, said grooving tool comprising:

a power drive unit;

a housing removably mounted on said power drive unit;

a grooving roller mounted on said housing and rotatable about a first axis, said grooving roller having a raised circumferential surface portion engageable with said sidewall for forming said groove;

a back-up roller mounted on said housing adjacent to said grooving roller, said back-up roller being rotatable about a second axis, one of said grooving roller and said back-up roller being movable toward and away from the other of said rollers for positioning said sidewall between said rollers and forcibly engaging said rollers with said sidewall on opposite sides of said sidewall;

a first shaft attached to one of said grooving and back-up rollers, said first-shaft being removably engaged with said power drive unit, rotation of said power drive unit causing said first shaft and said one roller to rotate;

a second shaft rotatably mounted on said housing;

a hand crank removably engageable with said second shaft for manual rotation thereof;

a transmission mounted on said housing, said transmission extending between said first and said second shafts such that rotation of said second shaft causes rotation of said first shaft thereby rotating said one roller;

wherein rotation of said one roller by said power drive unit when said housing is mounted thereon causes relative rotation between said pipe and said rollers for forming said groove; and wherein rotation of said one roller by said hand crank when said housing is removed from said power drive unit causes relative rotation between said pipe and said rollers for forming said groove.

13. A grooving tool according to claim 12, wherein said second axis is substantially parallel to said first axis.

14. A grooving tool according to claim 12, wherein said first shaft is attached to said back-up roller, said first shaft being substantially coaxially aligned with and rotatable about said second axis.

15. A grooving tool according to claim 14, wherein said back-up roller has a textured circumferential surface for engaging an inner surface of said sidewall.

16. A grooving tool according to claim 12, wherein said transmission comprises:

a gear attached to said first shaft and positioned coaxial therewith; and a pinion attached to said second shaft and positioned coaxial therewith, said pinion engaging said gear, said pinion transmitting rotational motion of said second shaft to said first shaft.

17. A grooving tool according to claim 16, wherein said gear has a pitch diameter between about 3 and about 8 times greater than said pinion.

18. A grooving tool according to claim 14, further comprising:

a secondary housing pivotably mounted on said housing, said grooving roller being rotatably mounted on said secondary housing, said grooving roller being pivotably movable toward and away from said back-up roller upon pivoting motion of said secondary housing; and means for forcibly pivoting said secondary housing relatively to said housing, said sidewall being positionable between said grooving and said back-up rollers, said rollers being forcibly engageable with said sidewall upon pivoting motion of said grooving roller toward said back-up roller by said pivoting means.

19. A grooving tool according to claim 18, wherein said pivoting means comprises a jackscrew assembly having a first end engaged with said housing and a second end engaged with said secondary housing, rotation of said jackscrew assembly pivotally moving said secondary housing relatively to said housing.

20. A grooving tool according to claim 12, further comprising an anti-torque arm mounted on said housing, said anti-torque arm being engageable with said power drive unit and preventing said housing from turning when said first shaft is rotated.

21. A grooving tool according to claim 20, wherein said anti-torque arm is removably mounted on said housing.

22. A grooving tool according to claim 12, further comprising an elongated extension shaft having a first end engageable with said power drive unit and a second end engageable with said first shaft, said extension shaft permitting engagement of said power drive unit to said first shaft with said grooving tool in spaced apart relation to said power drive unit.

* * * * *